US011319854B2

(12) United States Patent
Horimura et al.

(10) Patent No.: US 11,319,854 B2
(45) Date of Patent: May 3, 2022

(54) CATALYTIC DEVICE

(71) Applicants: HONDA MOTOR CO., LTD., Tokyo (JP); VITESCO TECHNOLOGIES GMBH, Schwalbach (DE)

(72) Inventors: Hiroyuki Horimura, Wako (JP); Kosaku Ito, Schwalbach a Ts. (DE); Francois Jayat, Schwalbach a Ts. (DE); Daiji Kawaguchi, Wako (JP); Kazuhisa Maeda, Wako (JP); Sven Seifert, Schwalbach a Ts. (DE); Michael Voit, Schwalbach a Ts. (DE)

(73) Assignees: HONDA MOTOR CO., LTD., Tokyo (JP); VITESCO TECHNOLOGIES GMBH, Schwalbach (DE)

( * ) Notice: Subject to any disclaimer, the term of this patent is extended or adjusted under 35 U.S.C. 154(b) by 0 days.

(21) Appl. No.: 17/265,530

(22) PCT Filed: Aug. 1, 2019

(86) PCT No.: PCT/JP2019/030216

§ 371 (c)(1),
(2) Date: Feb. 3, 2021

(87) PCT Pub. No.: WO2020/031841

PCT Pub. Date: Feb. 13, 2020

(65) Prior Publication Data

US 2021/0222604 A1 Jul. 22, 2021

(30) Foreign Application Priority Data

Aug. 10, 2018 (JP) ..... JP2018-151735

(51) Int. Cl.
*F01N 3/08* (2006.01)
*F01N 3/28* (2006.01)

(52) U.S. Cl.
CPC ..... *F01N 3/2821* (2013.01); *F01N 2330/02* (2013.01); *F01N 2350/04* (2013.01)

(58) Field of Classification Search
CPC . F01N 3/2821; F01N 2330/02; F01N 2350/04
(Continued)

(56) References Cited

U.S. PATENT DOCUMENTS 4,152,302 A * 5/1979 Nonnenmann ..... F01N 3/2814 502/338
5,130,208 A * 7/1992 Maus ..... F01N 3/2821 428/593

(Continued)

FOREIGN PATENT DOCUMENTS

| | | |
|---|---|---|
| DE | 4206812 | 9/1992 |
| EP | 0705962 | 4/1996 |
| JP | 2005-535454 | 11/2005 |

OTHER PUBLICATIONS

International Search Report and Written Opinion for International Application No. PCT/JP2019/030216 dated Sep. 19, 2019, 11 pages.

*Primary Examiner* — Tom P Duong
(74) *Attorney, Agent, or Firm* — Amin, Turocy & Watson, LLP

(57) ABSTRACT

A catalytic device that can increase the durability of a catalyst support with holes is provided. A flat plate and a corrugated plate have a plurality of holes, a joint area between the flat plate and the corrugated plate is provided in a first upstream area including one end of a catalyst support, and a joint area between the catalyst support and an outer cylinder is provided in a second upstream area that includes the first upstream area and is wider than the first upstream area in the direction of an axis.

4 Claims, 11 Drawing Sheets

(58) Field of Classification Search
USPC ..... 422/180
See application file for complete search history.

(56) References Cited

U.S. PATENT DOCUMENTS

| | | | | |
|---|---|---|---|---|
| 5,436,216 | A * | 7/1995 | Toyao | F01N 3/2026 502/439 |
| 5,648,050 | A * | 7/1997 | Matsumoto | B01J 35/04 422/169 |
| 5,791,043 | A * | 8/1998 | Okabe | B01J 35/04 156/209 |
| 5,821,194 | A | 10/1998 | In | |
| 6,761,980 | B2 * | 7/2004 | Sato | B01J 35/04 29/890 |
| 7,030,059 | B2 * | 4/2006 | Tanabe | B01J 35/04 422/180 |
| 7,981,498 | B2 * | 7/2011 | Maus | F01N 3/0222 428/116 |
| 9,381,467 | B2 * | 7/2016 | Murawaki | B01J 23/892 |
| 2004/0121908 | A1 * | 6/2004 | Tanabe | F01N 3/2821 502/439 |

* cited by examiner

CATALYTIC DEVICE

TECHNICAL FIELD

The present invention relates to a catalytic device that is formed by a flat plate and a corrugated plate that have holes being stacked and rolled and supports a catalyst support that fastens a catalyst thereto by housing the catalyst support in an outer cylinder.

BACKGROUND ART

A vehicle provided with an internal combustion engine includes an exhaust system for discharging exhaust gas that is generated in a combustion process of the internal combustion engine, out of the vehicle. The exhaust system includes a catalytic device that cleans up the exhaust gas. In Japanese Laid-Open Patent Publication No. 2005-535454 (PCT), a catalytic device for an internal combustion engine that is provided in an automobile is disclosed. This catalytic device includes a honeycomb body with holes (a catalyst support) that supports a catalyst and an outer cover pipe (an outer cylinder) that supports the catalyst support by housing the catalyst support. The catalyst support is formed by metal leaf-shaped flat thin plate (flat plate) and corrugated thin plate (corrugated plate) that have holes, being stacked and rolled.

SUMMARY OF INVENTION

When heat is applied to a catalyst support by exhaust gas, thermal stress is generated in the catalyst support. If a flat plate and a corrugated plate that form the catalyst support have large holes, the thermal stress becomes nonuniform and thermal strain is produced. Furthermore, the stiffness of a plate with holes is lower than the stiffness of a plate without holes. As described above, since thermal strain is easily produced in the catalyst support with holes and the stiffness of such a catalyst support is low, the catalyst support is deformed in some cases. In particular, because a catalyst becomes activated and the temperature of the catalyst increases near the center in the flow direction of the exhaust gas, large thermal strain is easily produced. If the members near the center are brazed and fixed, a brazed part and an area around the brazed part may be damaged.

The present invention has been made in view of such a problem and an object thereof is to provide a catalytic device that can improve the durability of a catalyst support having holes (holes-formed catalyst support).

The present invention is a catalytic device including: a catalyst support that is formed as a result of metal leaf-shaped flat plate and corrugated plate being stacked and rolled and supports a catalyst; and an outer cylinder that houses the catalyst support and supports the catalyst support with one end of the catalyst support made to face an upstream side of exhaust gas and the other end of the catalyst support made to face a downstream side of the exhaust gas. The flat plate and the corrugated plate have a plurality of holes. In a flat state in which the flat plate and the corrugated plate are not yet shaped into the catalyst support, the plurality of holes form a plurality of first lines by aligning in a first direction that is parallel to the direction of the axis of the catalyst support and form a plurality of second lines by aligning in a second direction that is orthogonal to the first direction. A joint area between the flat plate and the corrugated plate is provided in a first upstream area including the one end of the catalyst support, and a joint area between the catalyst support and the outer cylinder is provided in a second upstream area including the one end of the catalyst support.

According to the present invention, it is possible to increase the durability of a holes-formed catalyst support.

DESCRIPTION OF EMBODIMENTS

Hereinafter, preferred embodiments of a catalytic device according to the present invention will be described in detail with reference to the accompanying drawings.

In the descriptions below, upstream and downstream are defined with respect to the flow of exhaust gas.

1. Exhaust System 14

Figure 1:
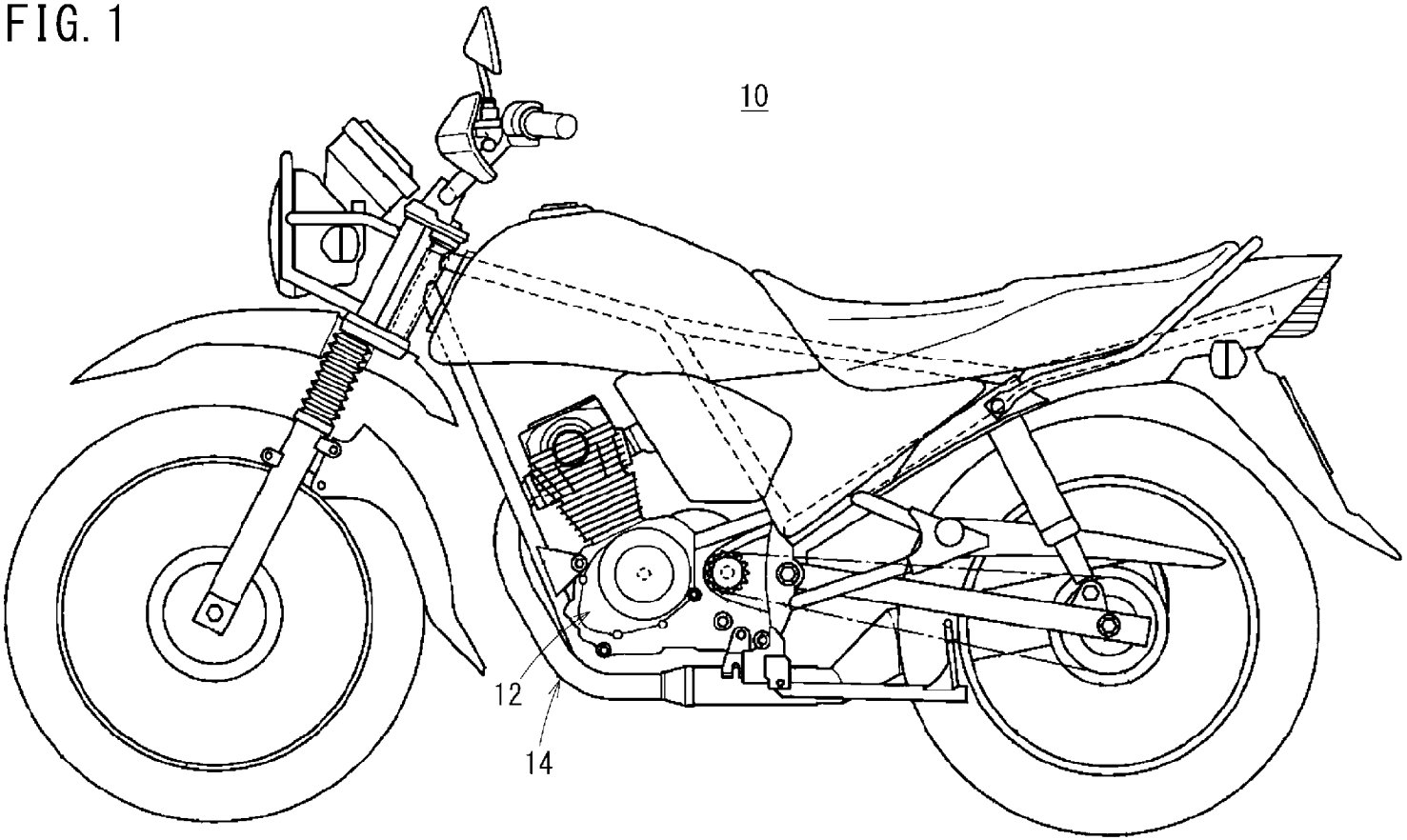
FIG. 1 is a left side view of a motorcycle.

As depicted in FIG. 1, a motorcycle 10 includes an internal combustion engine 12 as a drive source for travel. To the internal combustion engine 12, an exhaust system 14 is connected.

Figure 2:
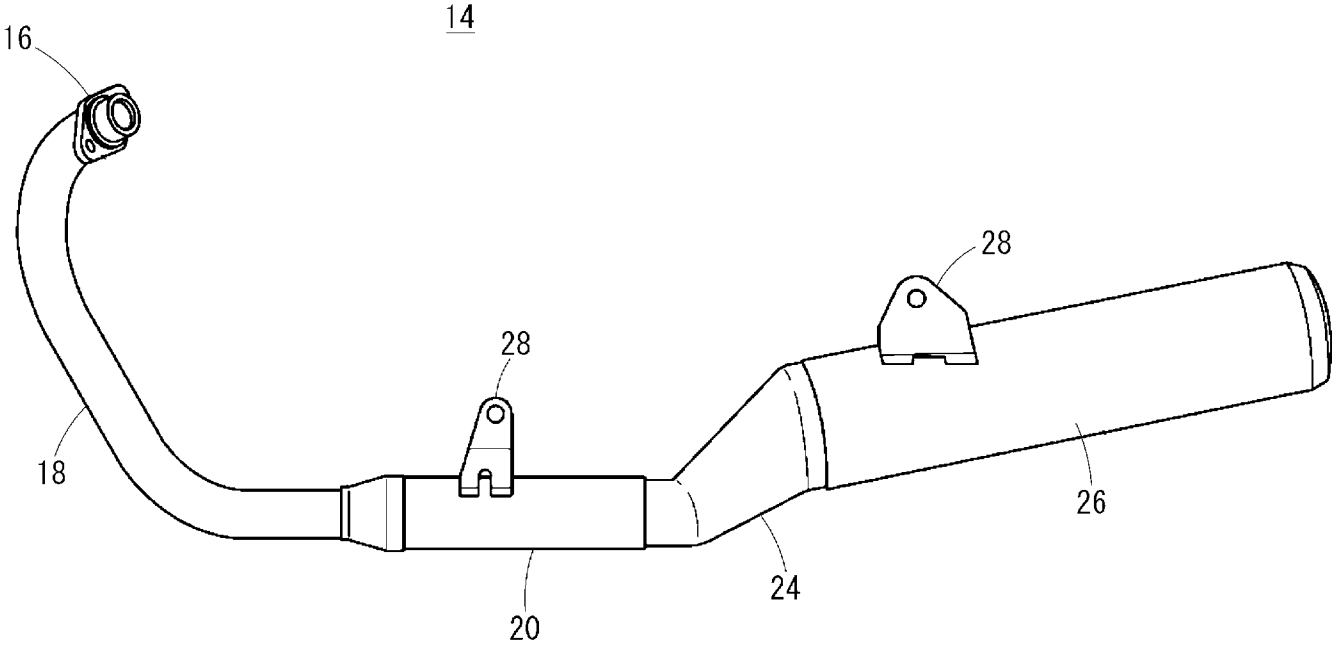
FIG. 2 is a left side view of an exhaust system.

As depicted in FIG. 2, the exhaust system 14 includes a flange 16, an upstream-side exhaust pipe 18, a catalyst storing portion 20, a downstream-side exhaust pipe 22 (FIG. 3), a heat shield cover 24, and a muffler 26. The upstream-side exhaust pipe 18 is connected to a cylinder head of the internal combustion engine 12 by the flange 16. The catalyst storing portion 20 is connected to a downstream-side end of the upstream-side exhaust pipe 18. The configuration of the catalyst storing portion 20 will be described in [2] below. The downstream-side exhaust pipe 22 (FIG. 3) is connected to a downstream-side end of the catalyst storing portion 20. The heat shield cover 24 is connected to the downstream-side end of the catalyst storing portion 20 in such a way as to cover the downstream-side exhaust pipe 22. The muffler 26 is connected to downstream-side ends of the downstream-side exhaust pipe 22 and the heat shield cover 24. The exhaust system 14 is attached to a frame of a vehicle body by one or more stays 28. With this structure, exhaust gas that is discharged from the internal combustion engine 12 is discharged to the outside after passing through the upstream-side exhaust pipe 18, the catalyst storing portion 20, the downstream-side exhaust pipe 22, and the muffler 26.

2. Catalyst Storing Portion 20

Figure 3:
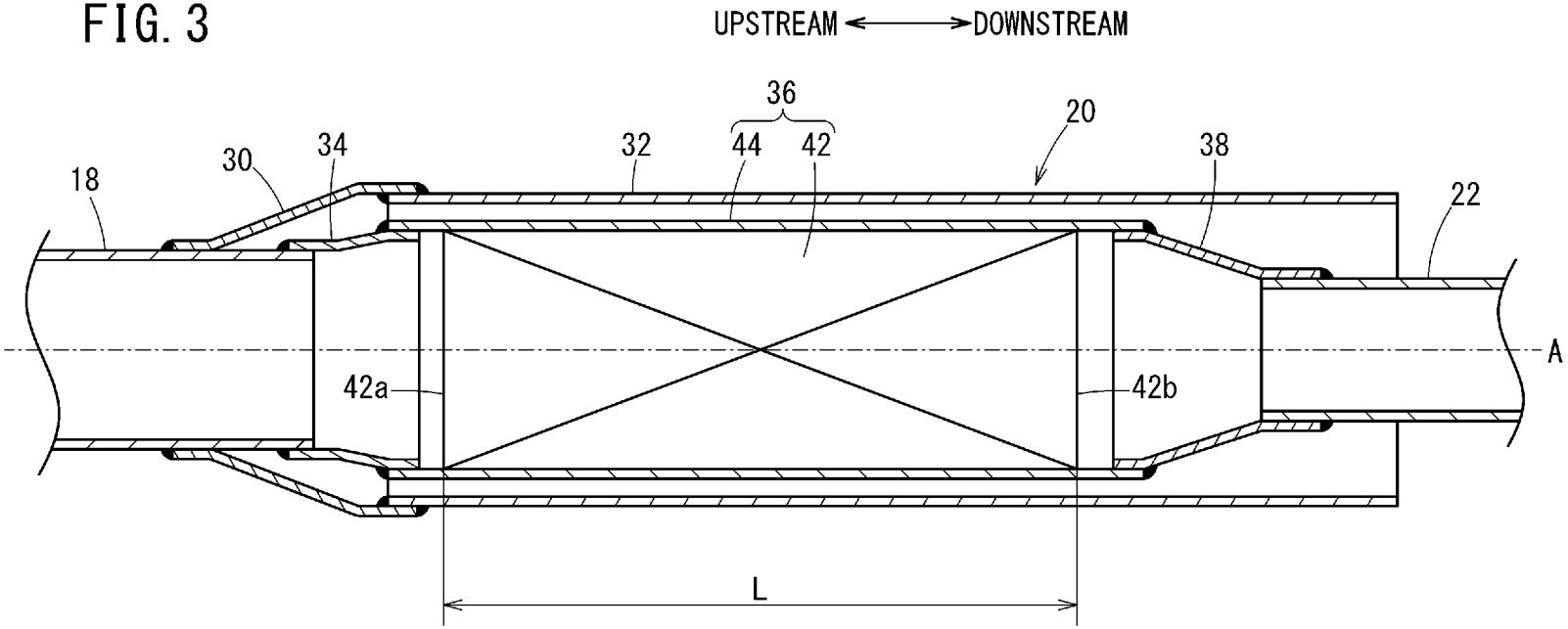
FIG. 3 is a sectional view of a catalyst storing portion.

As depicted in FIG. 3, the catalyst storing portion 20 includes an outer taper pipe 30, a heat shield pipe 32, an upstream-side inner taper pipe 34, a catalytic device 36, and a downstream-side inner taper pipe 38. The outer taper pipe 30 is connected to the downstream-side end of the upstream-side exhaust pipe 18. The heat shield pipe 32 is connected to a downstream-side end of the outer taper pipe 30. The upstream-side inner taper pipe 34 is connected to the downstream-side end of the upstream-side exhaust pipe 18 at a downstream site from a connection between the outer taper pipe 30 and the upstream-side exhaust pipe 18, and is located inside the outer taper pipe 30. The catalytic device 36 is connected to a downstream-side end of the upstream-side inner taper pipe 34 and located inside the heat shield pipe 32. The configuration of the catalytic device 36 will be described in [3] below. The downstream-side inner taper pipe 38 is connected to a downstream-side end of the catalytic device 36 and located inside the heat shield pipe 32.

3. Catalytic Device 36

Figure 4:
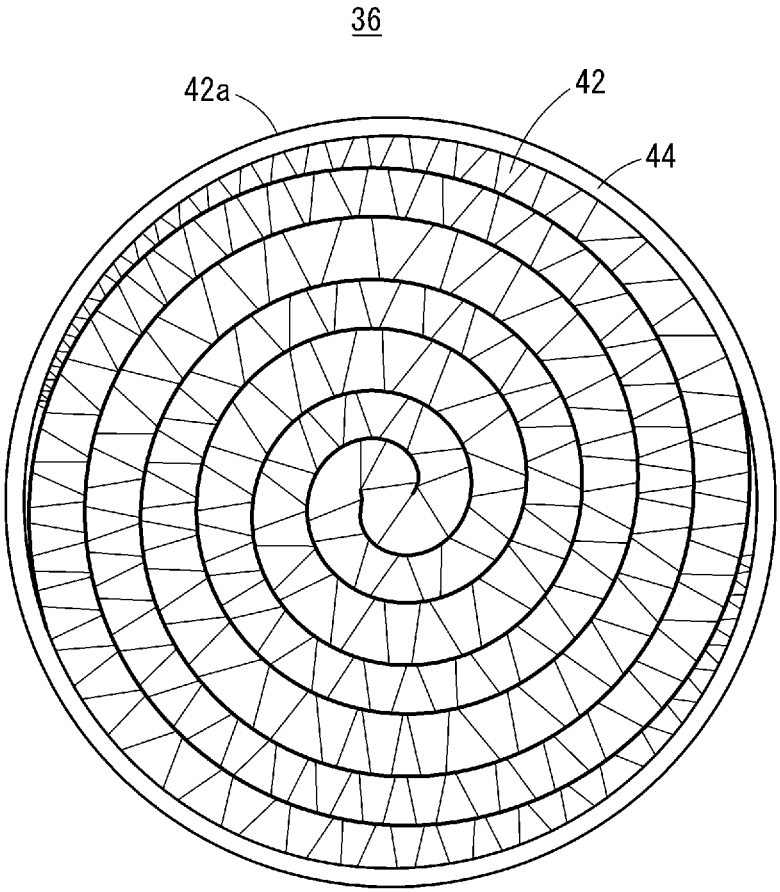
FIG. 4 is a schematic diagram schematically depicting a catalytic device viewed from an upstream side.

As depicted in FIGS. 3 and 4, the catalytic device 36 includes a catalyst support 42 and an outer cylinder 44. The catalyst support 42 is substantially in the shape of a cylinder having a honeycomb structure and is formed by one or more metal leaf-shaped flat plates 52 and one or more corrugated plates 54 that are corrugated metal leaf-shaped flat plates 52, with the metal leaf-shaped flat plates 52 and the corrugated plates 54 being stacked and rolled. Each flat plate 52 (and each corrugated plate 54) is formed of stainless steel and has a plurality of holes 64 (FIGS. 5 and 6) passing therethrough from one side to the other side. The holes 64 will be described in [3.1] below.

The catalyst support 42 supports a catalyst. For example, in the state of the catalyst support 42, the surfaces of the flat plate 52 and the corrugated plate 54 are covered with coating containing a catalytic material (for instance, elements of the platinum group, such as platinum, palladium, and rhodium). The flat plate 52 and the corrugated plate 54 are joined to each other. Joining of the flat plate 52 and the corrugated plate 54 will be described in [3.2] below.

The outer cylinder 44 is a cylinder whose inner diameter is slightly larger than the outer diameter of the catalyst support 42. As in the case of the flat plate 52, the outer cylinder 44 is formed of stainless steel. The outer cylinder 44 houses the catalyst support 42. The outer cylinder 44 supports the catalyst support 42 in a state in which one end 42*a* of the catalyst support 42 is made to face the upstream side of the exhaust gas and the other end 42*b* of the catalyst support 42 is made to face the downstream side of the exhaust gas. In a state in which the outer cylinder 44 is supporting the catalyst support 42, the axis of the outer cylinder 44 and the axis of the catalyst support 42 coincide with each other. As depicted in FIG. 3, the axis of the outer cylinder 44 and the catalyst support 42 is referred to as an axis A. The outer circumferential surface of the catalyst support 42 and the inner circumferential surface of the outer cylinder 44 are joined to each other. Joining of the catalyst support 42 and the outer cylinder 44 will be described in [3.2] below.

3.1. The Flat Plate 52 with the Holes 64

3.1.1. Example 1

Figure 5:
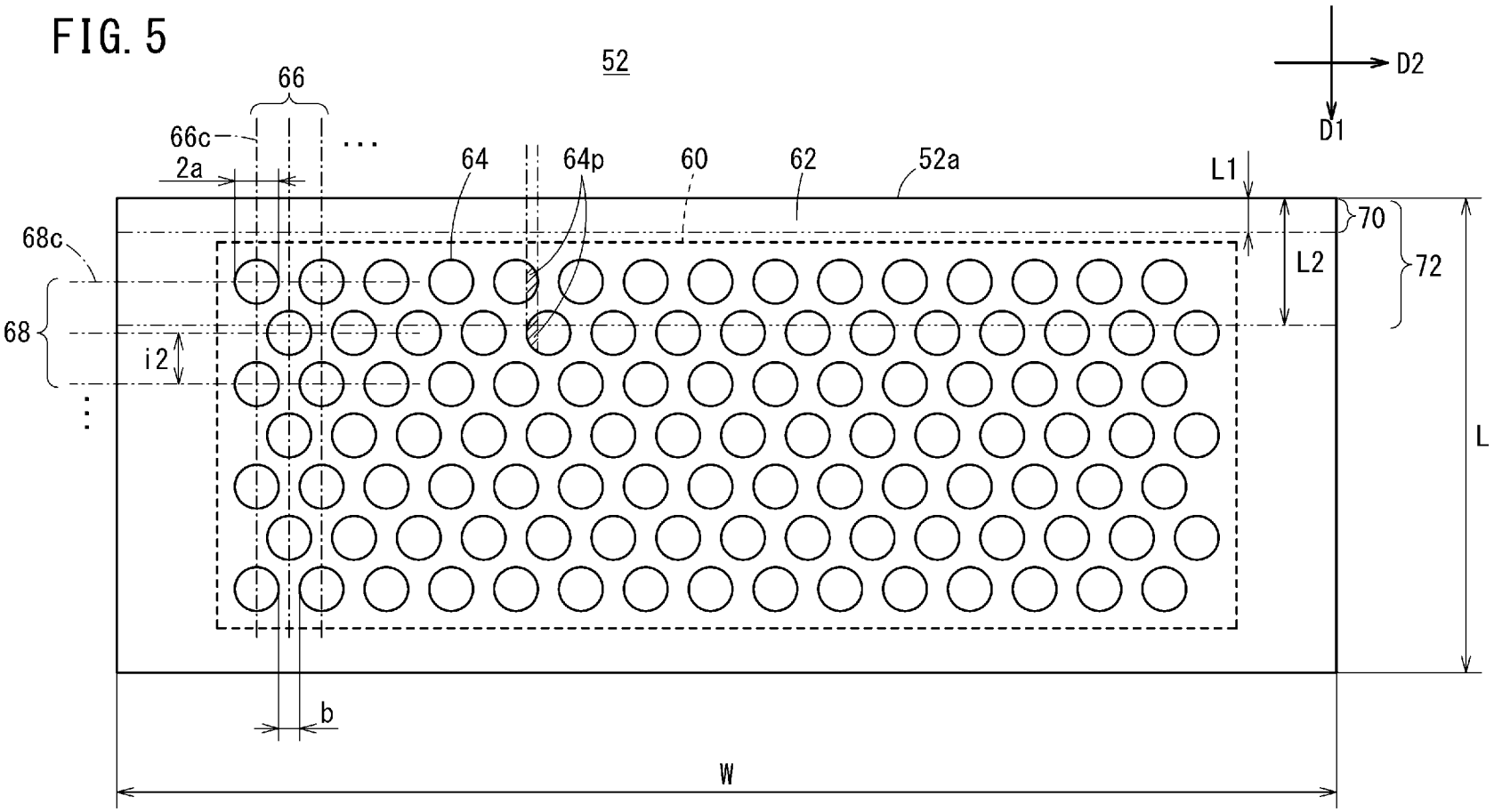
FIG. 5 is a schematic diagram schematically depicting a flat plate according to Example 1.

The flat plate 52 of Example 1 will be described by using FIG. 5. The flat plate 52 depicted in FIG. 5 is in a flat state in which the flat plate 52 is not yet shaped into the catalyst support 42. The flat plate 52 is a substantially rectangular metal leaf-shaped member of a length L in a first direction D1 and a length W (>L) in a second direction D2. The first direction D1 is parallel to the direction of the flow of the exhaust gas and the direction of the axis of the catalyst support 42 (a direction in which the axis A extends). In FIG. 5, a direction from the top to the bottom on the plane of paper is assumed to be the first direction D1. The second direction D2 is orthogonal to the first direction D1. In FIG. 5, a direction from the left to the right on the plane of paper is assumed to be the second direction D2. The length L of the flat plate 52 in the first direction D1 is the length of the catalyst support 42 in the direction of the axis thereof. The length W of the flat plate 52 in the second direction D2 is related to the diameter of the catalyst support 42. Therefore, the length L and the length W are determined in accordance with the design of the catalyst support 42.

The flat plate 52 has a hole formation portion 60 and an edge portion 62 surrounding the hole formation portion 60. The flat plate 52 has, in the hole formation portion 60, a plurality of holes 64 aligning in the first direction D1 and the second direction D2. A line of the holes 64 in the first direction D1 is referred to as a first line 66. A line of the holes 64 in the second direction D2 is referred to as a second line 68. When a line connecting the centers of the holes 64 in the first line 66 is called a center line 66*c* of the line, the holes 64 are arranged in such a way that the center lines 66*c* are spaced uniformly. When a line connecting the centers of the holes 64 in the second line 68 is called a center line 68*c* of the line, the holes 64 are arranged in such a way that the center lines 68*c* are spaced uniformly.

The first lines 66 are numbered consecutively toward the second direction D2. The holes 64 on an n-th first line 66 and the holes 64 on an n+1-th first line 66 alternately form a line when viewed from one (or the other) side of the second direction D2. That is, when viewed from one (or the other) side of the second direction D2, one hole 64 of the n+1-th first line 66 is disposed between two holes 64 that are adjacent to each other in the n-th first line 66 and one hole 64 of the n-th first line 66 is disposed between two holes 64 that are adjacent to each other in the n+1-th first line 66.

Likewise, the second lines 68 are numbered consecutively from one side to the other side in the first direction D1. The holes 64 on an n-th second line 68 and the holes 64 on an n+1-th second line 68 alternately form a line when viewed from one (or the other) side of the first direction D1. That is, when viewed from one (or the other) side in the first direction D1, one hole 64 of the n+1-th second line 68 is disposed between two holes 64 that are adjacent to each other in the n-th second line 68 and one hole 64 of the n-th second line 68 is disposed between two holes 64 that are adjacent to each other in the n+1-th second line 68.

Of two (n-th and n+1-th) adjacent first lines 66, the holes on one (n-th) first line 66 and the holes 64 on the other (n+1-th) first line 66 overlap each other by portions 64*p* when viewed from the first direction D1. The length of each of the overlapping portions 64*p* in the second direction D2 is more than 0 and less than or equal to 20% of the length (for instance, the diameter 2*a*) of the holes 64 in the second direction D2. On the other hand, of two (n-th and n+1-th) second lines 68, the holes 64 on one (n-th) second line 68 and the holes 64 on the other (n+1-th) second line 68 are separated from each other when viewed from the second direction D2.

Here, a specific example of the flat plate 52 of Example 1 will be described. The hole 64 is circular in shape. The radius a of the hole 64 is 4.0 mm (the diameter thereof is 8.0 mm). The interval i2 between the second lines 68 that are adjacent to each other (that is, the interval i2 between an n-th second line 68 and an n+1-th second line 68) is 9.52 mm. The distance b between the ends of two holes 64 that are adjacent to each other is 3 mm.

These shapes and numerical values are given by way of example and other shapes and numerical values may be adopted. For instance, the hole 64 may be oval in shape; in that case, any one of the major axis and the minor axis may be parallel to the first direction D1 or the second direction D2.

Moreover, the size (for example, the diameter 2*a*) of the holes 64 that are disposed in the region of the portions 64*p* may be smaller than the size (for example, the diameter 2*a*) of the holes 64 that are disposed in another region. In particular, it is preferable to make smaller the size of the holes 64 included in a given second line 68 (1st to k-th second lines 68) counted up from the second line 68 on the upstream side, that is, from a first end 52*a* side that is the one end 42*a* of the catalyst support 42. Specifically, when the hole 64 is circular in shape, the size and arrangement of the holes 64 can be set so that a relation, the distance b>the radius a, holds. Making smaller the size of the holes 64 on the upstream side increases durability to withstand the vibration (that is called fluttering) of the catalyst support 42 caused by pulsation of the exhaust gas.

The corrugated plate 54 is formed by elongating the flat plate 52 in the second direction D2 into a metal leaf-shaped member and processing the metal leaf-shaped member into the form of waves arranged in the second direction D2. The outer shape of the corrugated plate 54 is substantially the same as that of the flat plate 52 when viewed in a plan view. Amplitude of the waves of the corrugated plate 54 gradually increases and decreases: the waves of the corrugated plate 54 forms, for example, a sinusoidal wave. The holes 64 of the corrugated plate 54 are arranged in the same manner as those of the flat plate 52. However, since the corrugated plate 54 is longer than the flat plate 52 in the second direction D2, the hole formation portion 60 is wider in the second direction D2 and there are more holes 3.1.2. Example 2

Figure 6:
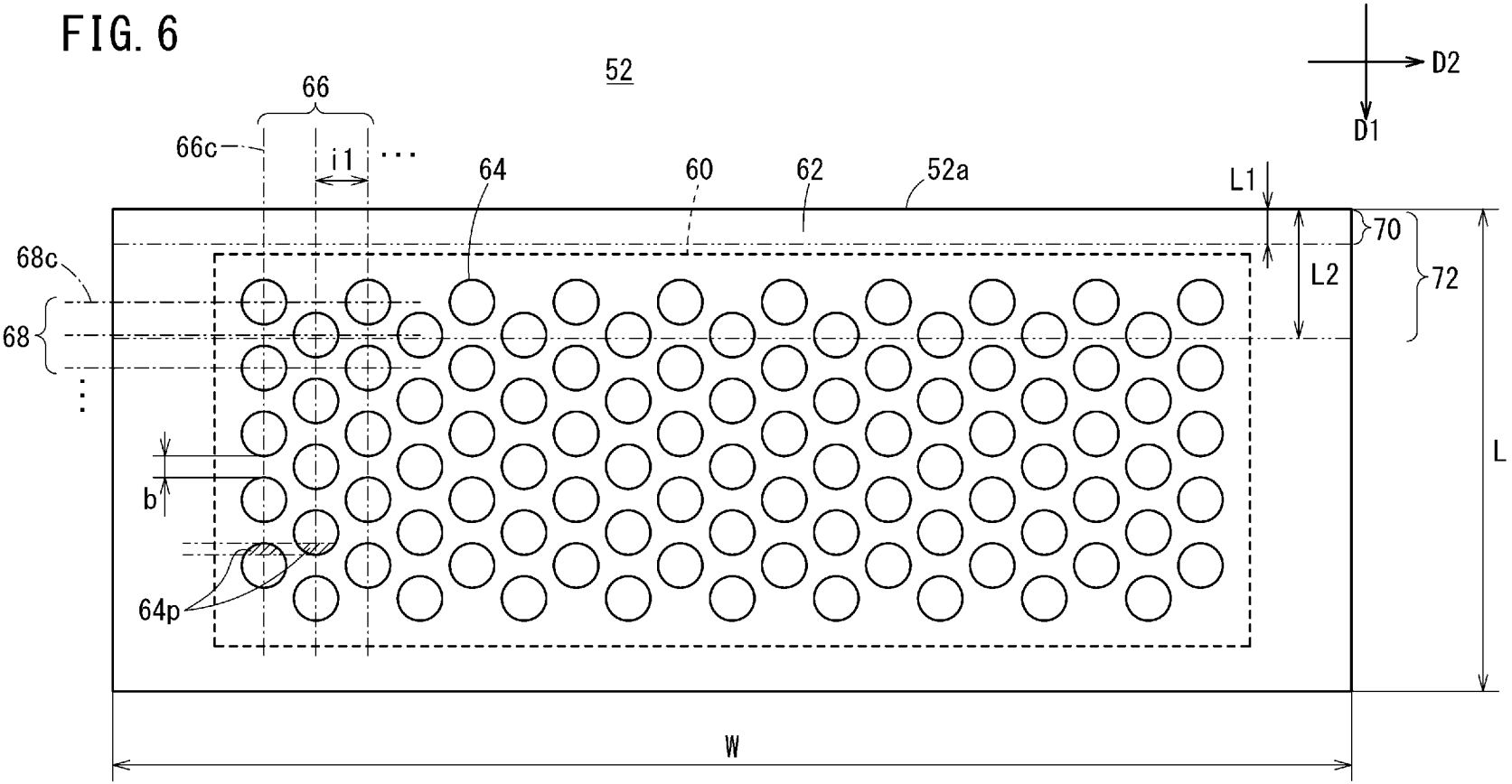
FIG. 6 is a schematic diagram schematically depicting a flat plate according to Example 2.

The flat plate 52 of Example 2 will be described by using FIG. 6. The flat plate 52 depicted in FIG. 6 corresponds to the flat plate 52 obtained by rotating the arrangement of the holes 64 of the flat plate 52 depicted in FIG. 5 by 90° within the hole formation portion 60. The configuration of the flat plate 52 depicted in FIG. 6 is the same as the configuration of the flat plate 52 depicted in FIG. 5 except for the arrangement of the holes 64. In the explanations below, portions of the flat plate 52 depicted in FIG. 6 that are different from the flat plate 52 depicted in FIG. 5 will be described.

Of two (n-th and n+1-th) adjacent first lines 66, the holes 64 on one (an n-th first line 66) first lines 66, and the holes 64 on the other (n+1-th) first line 66 are separated from each other when viewed from the first direction D1. On the other hand, of two (n-th and n+1-th) adjacent second lines 68, the holes 64 on one (an n-th second line 68) second line 68 and the holes 64 on the other (n+1-th) second line 68 overlap each other by portions 64*p* when viewed from the second direction D2. The length of each of the overlapping portions 64*p* in the first direction D1 is more than 0 and less than or equal to 20% of the length (for instance, the diameter 2*a*) of the holes 64 in the second direction D2.

Here, a specific example of the flat plate 52 of Example 2 will be described. The hole 64 is circular-shaped. The radius a of the hole 64 is 4.0 mm (the diameter thereof is 8.0 mm). The interval i1 between the first lines 66 that are adjacent to each other (that is, the interval i1 between an n-th first line 66 and an n+1-th first line 66) is 9.52 mm. The distance b between the ends of two adjacent holes 64 is 3 mm.

As in the case of Example 1, these shapes and numerical values are given by way of example and other shapes and numerical values may be adopted. For instance, the hole 64 may be oval in shape; in that case, any one of the major axis and the minor axis may be parallel to the first direction D1 or the second direction D2.

As in the case of Example 1, the size (for example, the diameter 2*a*) of the holes 64 that are disposed in the region of the portions 64*p* may be smaller than the size (for example, the diameter 2*a*) of the holes 64 that are disposed in another region. In particular, it is preferable to make smaller the size of the holes 64 included in a given second lines 68 (1st to k-th second lines 68) counted up from the second line 68 on the upstream side, that is, from a first end 52*a* side that is the one end 42*a* of the catalyst support 42. Specifically, when the hole 64 is circular in shape, the size and arrangement of the holes 64 can be set so that a relation, the distance b>the radius a, holds. Making smaller the size of the holes 64 on the upstream side increases durability to withstand the vibration (that is called fluttering) of the catalyst support 42 caused by pulsation of the exhaust gas.

With the holes 64 formed in the flat plate 52 and the corrugated plate 54 as in Examples 1 and 2, a turbulent flow (a vortex) tends to be generated in the exhaust gas flowing through the catalyst support 42. When the turbulent flow is generated in the exhaust gas, the exhaust gas comes into contact with the catalyst more frequently, whereby the exhaust gas cleanup efficiency improves. Furthermore, when the holes 64 are formed in the flat plate 52 and the corrugated plate 54, the length of the flow channel of the exhaust gas is substantially increased. When the length of the flow channel of the exhaust gas is increased, the exhaust gas comes into contact with the catalyst more frequently, whereby the exhaust gas cleanup efficiency improves.

3.2. Joining of the Members 3.2.1. Joining on the Upstream Side

Figure 7:
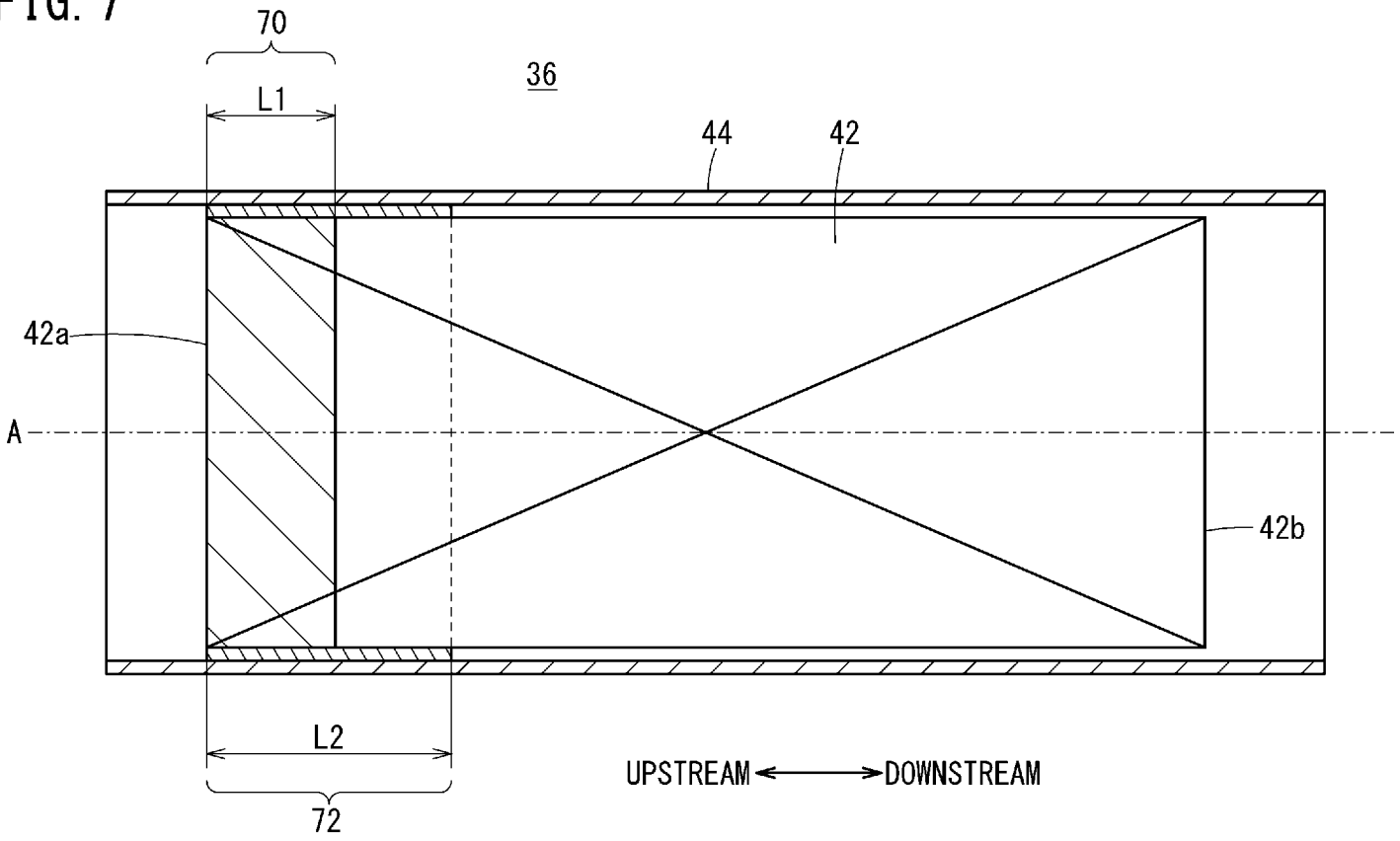
FIG. 7 is an explanatory diagram for an explanation of a brazing part.

Joining of the flat plate 52 and the corrugated plate 54 and joining of the catalyst support 42 and the outer cylinder 44 will be described by using FIG. 7. FIG. 7 shows joint areas of the members in the catalytic device 36 depicted in FIG. 3. The flat plate 52 and the corrugated plate 54 are joined together by brazing, and the catalyst support 42 and the outer cylinder 44 are also joined together by brazing.

In the present embodiment, a portion on the upstream side in which the flat plate 52 and the corrugated plate 54 are brazed to one another is referred to as a first upstream area 70 and a portion in which the catalyst support 42 and the outer cylinder 44 are brazed to one another is referred to as a second upstream area 72. The first upstream area 70 is an area that spreads from the position of the one end 42*a* of the catalyst support 42 to a position that is away therefrom by a length L1 to the downstream side in the direction of the axis. The second upstream area 72 is an area that spreads from the position of the one end 42*a* of the catalyst support 42 to a position away therefrom by a length L2 to the downstream side in the direction of the axis. The length L2 is longer than the length L1. That is, the second upstream area 72 is wider than the first upstream area 70 to the downstream side in the direction of the axis.

Specifically, the length L1 can be set at 3 mm and the length L2 can be set at 10 mm. The reason is as follows: the temperature of the exhaust gas is relatively low in this range. In the case of Examples 1 and 2 (the radius a=4.0 mm, the distance b=3 mm) described above, as depicted in FIGS. 5 and 6, the downstream-side boundary of the second upstream area 72 crosses the holes 64 of the 2nd second line 68.

In the catalyst support 42 located in the first upstream area 70, the flat plate 52 and the corrugated plate 54 are brazed to each other from the center to the outer circumference. The first upstream area 70 contains the edge portions 62 of the flat plate 52 and the corrugated plate 54 and a plurality of holes 64 on the first to k-th (given ordinal number) second lines 68. Substantially peak parts of wave portions included in the corrugated plate 54 are brazed to the flat plate 52. However, it is difficult to braze all the contact points between the flat plate 52 and the corrugated plate 54 that are included in the first upstream area 70. For this reason, in the present embodiment, brazing all the contact points is not required.

The catalyst support 42 and the outer cylinder 44 that are located in the second upstream area 72 are brazed to each other. Specifically, the outer circumferential surface of the catalyst support 42 and the inner circumferential surface of the outer cylinder 44 are brazed to one another.

The closer to the upstream side, the greater the vibration of the catalytic device 36. By joining the flat plate 52 and the corrugated plate 54 together in the first upstream area 70 and joining the catalyst support 42 and the outer cylinder 44 together in the second upstream area 72 as in the present embodiment, it is possible to efficiently suppress the vibration of the catalyst support 42. Furthermore, since the members are not joined together along the length of the catalyst support 42, it is possible to prevent the catalyst support 42 from being damaged as a result of the members expanding and contracting under the influence of heat.

3.2.2. Joining on the Downstream Side

Figure 8:
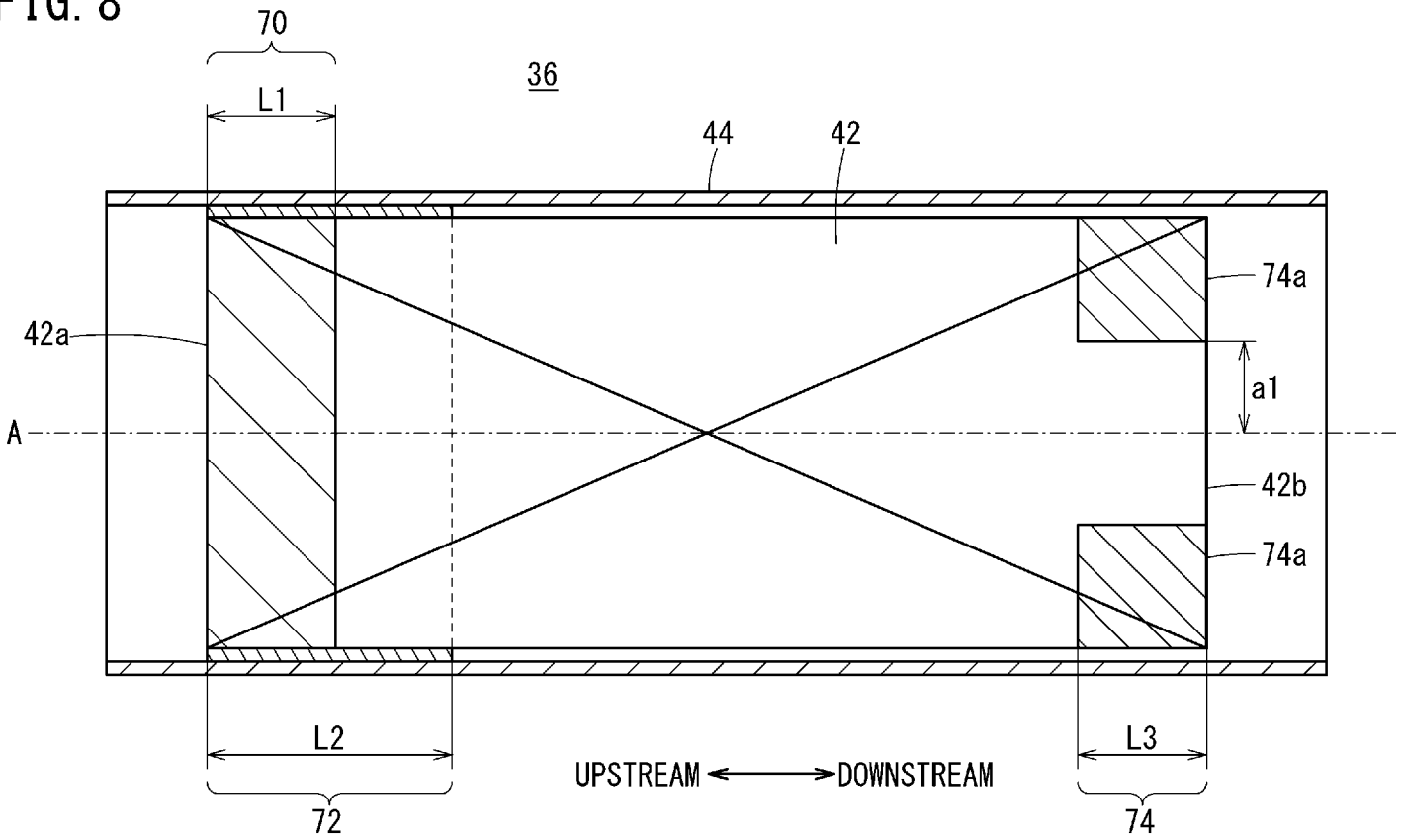
FIG. 8 is an explanatory diagram for an explanation of the brazing part.
Figure 9:
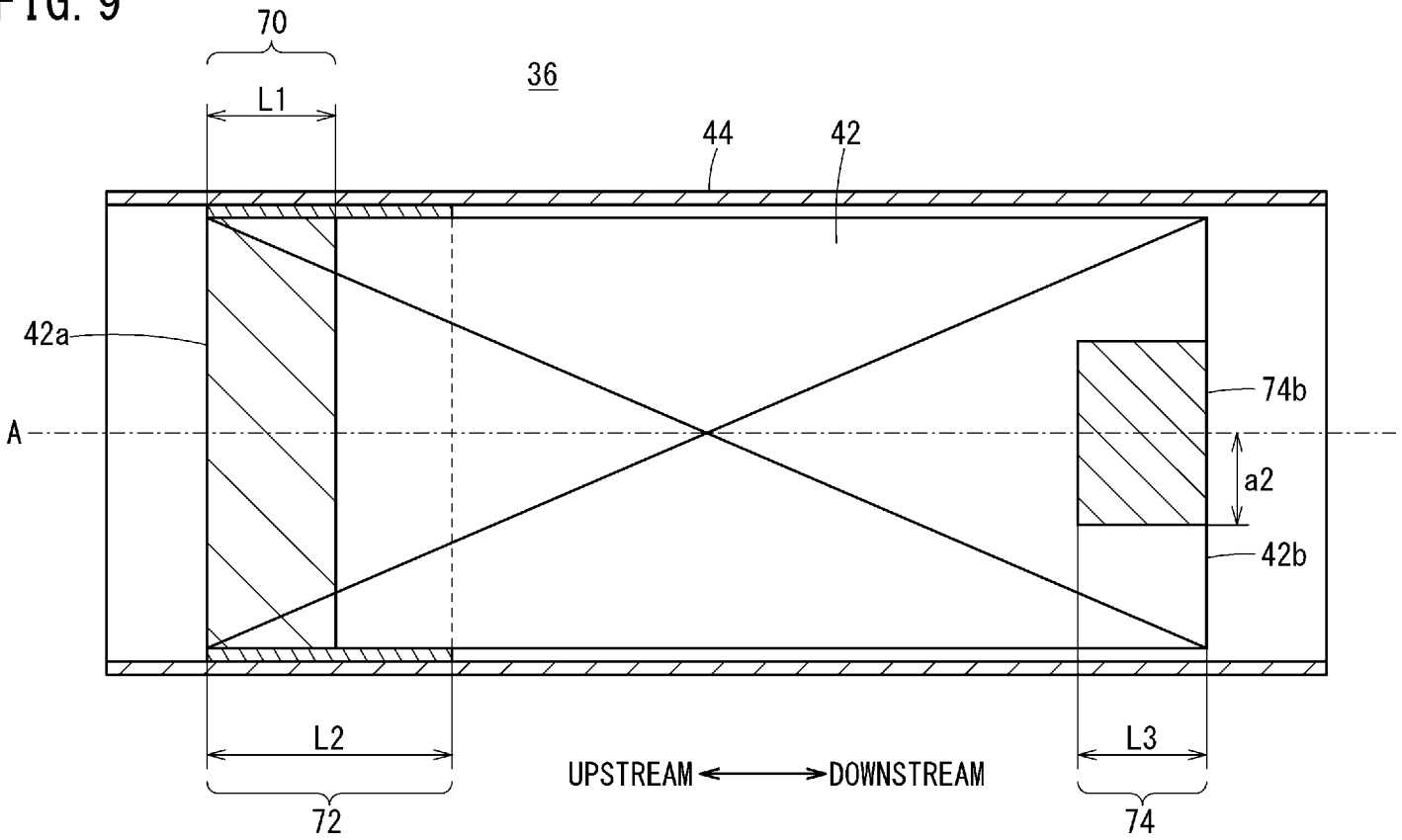
FIG. 9 is an explanatory diagram for an explanation of the brazing part.
Figure 10:
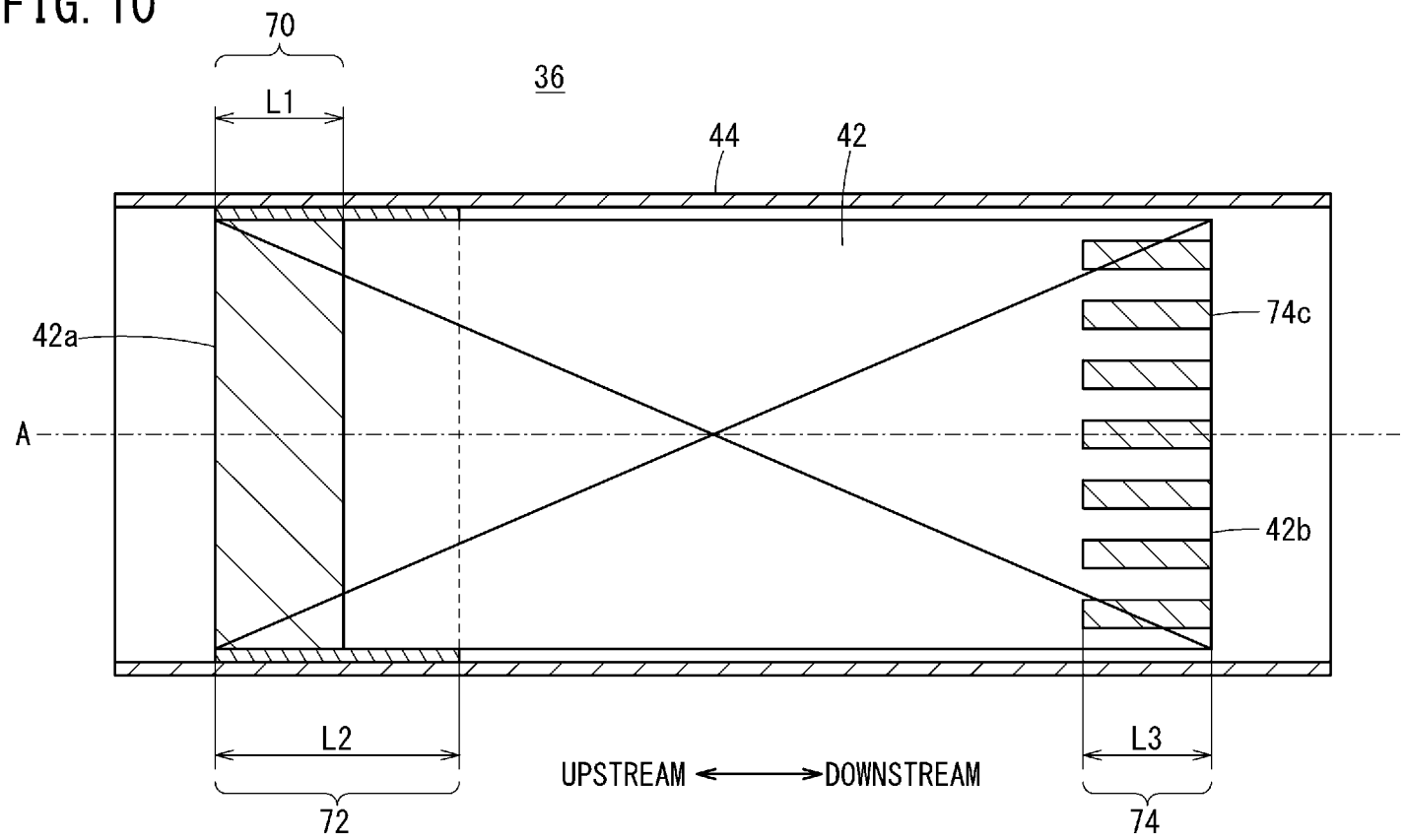
FIG. 10 is an explanatory diagram for an explanation of the brazing part.

In addition to brazing the flat plate 52 and the corrugated plate 54 to one another on the upstream side as described above, the flat plate 52 and the corrugated plate 54 may be brazed to one another on the downstream side. In FIGS. 8 to 10, a portion on the downstream side in which the flat plate 52 and the corrugated plate 54 are brazed to one another is referred to as a downstream area 74. The downstream area 74 is an area that spreads from the position of the other end 42*b* of the catalyst support 42 to a position that is away therefrom by a length L3 to the upstream side in the direction of the axis.

As depicted in FIG. 8, of an area that is away from the center in the radial direction in the downstream area 74, the flat plate 52 and the corrugated plate 54 may be brazed to each other in a peripheral area 74*a*, which is located on the outer circumferential side. The peripheral area 74*a* lies from a position away from the axis A by a distance a1 in the radial direction to the outer circumferential position.

As depicted in FIG. 9, of an area away from the center in the radial direction in the downstream area 74, the flat plate 52 and the corrugated plate 54 may be brazed to each other in a central area 74*b*, which is located on the center side. The central area 74*b* lies from the axis A to a position away therefrom by a distance a2 in the radial direction.

As depicted in FIG. 10, in the downstream area 74, a brazing area 74*c* in which the flat plate 52 and the corrugated plate 54 are brazed to one another and a non-brazing area 74*c* in which the flat plate 52 and the corrugated plate 54 are not brazed to one another may be provided at regular intervals or at irregular intervals in a direction in which the flat plate 52 and the corrugated plate 54 are rolled.

4. A Method for Producing the Catalytic Device 36

Figure 11:
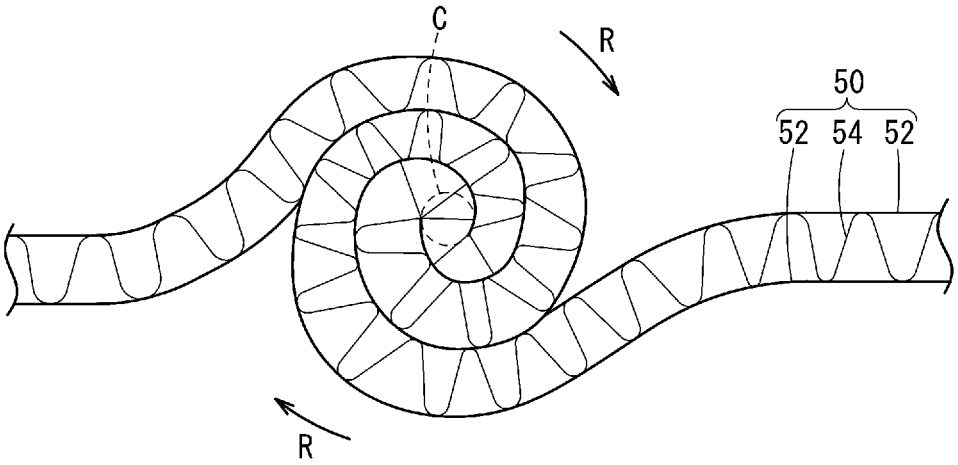
FIG. 11 is an explanatory diagram for an explanation of a method for producing a catalyst support.

As depicted in FIG. 11, by supporting a central portion C of a stacked body 50 that is formed by stacking the flat plate 52 on both sides of the corrugated plate 54, with a support member and by rotating the support member, the central portion C is rotated in one direction R, whereby the catalyst support 42 in which the stacked body 50 is stacked from the center toward the radial direction is formed. In so doing, the flat plate 52 and the corrugated plate 54 are brazed to one another and the catalyst support 42 is formed into a substantially cylindrical shape.

The stacked body 50 may be a plurality of layers formed of a plurality of flat plates 52 and a plurality of corrugated plates 54 that are alternately stacked. Moreover, as described in Japanese Laid-Open Patent Publication No. 2005-535454 (PCT) mentioned above, the catalyst support 42 may be formed by supporting an end of the stacked body 50 with the support member and by rotating the support member in the direction R.

Next, the substantially cylindrical catalyst support 42 is inserted into the outer cylinder 44 and the catalyst support 42 and the outer cylinder 44 are brazed to one another.

Next, a high-viscosity mixed solution containing the catalytic material is placed on the side of the catalyst support 42 where the one end 42*a* thereof is located, and a difference in pressure is generated by making the atmospheric pressure on the side where the other end 42*b* is located lower than the atmospheric pressure on the side where the one end 42*a* is located. Then, the mixed solution is sucked to the side where the other end 42*b* is located, whereby the mixed solution enters the honeycomb catalyst support 42 from the side where the one end 42*a* is located. When passing through the inside of the catalyst support 42, the mixed solution is sucked to the side where the other end 42*b* is located while making contact with the front surfaces of the flat plate 52 and the corrugated plate 54. As a result, the inner surface of the catalyst support 42 (the surfaces of the flat plate 52 and the corrugated plate 54) is covered with coating containing the catalytic material.

5. An Invention that is Obtained by the Embodiment

An invention that can be understood from the above-mentioned embodiment will be described below.

The present invention is the catalytic device 36 including: the catalyst support 42 that is formed by the metal leaf-shaped flat plate 52 and corrugated plate 54 being stacked and rolled and supports the catalyst; and the outer cylinder 44 that houses the catalyst support 42 and supports the catalyst support 42 with the one end 42*a* of the catalyst support 42 made to face the upstream side of the exhaust gas and the other end 42*b* of the catalyst support 42 made to face the downstream side of the exhaust gas. The flat plate 52 and the corrugated plate 54 have a plurality of holes 64. In a flat state in which the flat plate 52 and the corrugated plate 54 are not yet shaped into the catalyst support 42, the plurality of holes 64 form a plurality of first lines 66 by aligning in the first direction D1 that is parallel to the direction of the axis of the catalyst support 42 and form a plurality of second lines 68 by aligning in the second direction D2 that is orthogonal to the first direction D1. A joint area between the flat plate 52 and the corrugated plate 54 is provided in the first upstream area 70 including the one end 42*a* of the catalyst support 42, and a joint area between the catalyst support 42 and the outer cylinder 44 is provided in the second upstream area 72 including the one end 42*a* of the catalyst support 42.

Although the one end 42*a* of the catalyst support 42, which is the upstream-side end thereof, and a portion around the one end 42*a* are heated by the exhaust gas, the one end 42*a* and the portion around the one end 42*a* are less affected by the heat generation caused by the activation of the catalyst. As a result of the joint area between the flat plate 52 and the corrugated plate 54 and the joint area between the catalyst support 42 and the outer cylinder 44 being provided on the upstream side (the first upstream area 70 and the second upstream area 72), not near a central region in which the highest temperature is observed, it is possible to reduce the influence of the heat generation of the activated catalyst on the holes-formed catalyst support 42. This makes it possible to increase the durability of the holes-formed catalyst support 42.

In the present invention, the joint area between the catalyst support 42 and the outer cylinder 44 may be provided in the second upstream area 72 that includes the first upstream area 70 and is wider than the first upstream area 70 in the direction of the axis.

By making the second upstream area 72 wider than the first upstream area 70 as in the configuration described above, it is possible to increase the durability of the holes-formed catalyst support 42 more suitably.

In the present invention, in the first upstream area 70, a predetermined number of second lines 68 may be included.

In an area of a predetermined length from the one end 42*a* of the catalyst support 42, which is the upstream-side end thereof, since the influence of the heat generation caused by the activation of the catalyst is small, the temperature of the exhaust gas is relatively low. In particular, the temperature of the exhaust gas is low in an area of about 10 mm to the downstream side from the one end 42*a*. It is preferable to perform brazing of the members in this area.

In the present invention, the joint area between the flat plate 52 and the corrugated plate 54 may be provided in the downstream area 74 including the other end 42*b* of the catalyst support 42.

It goes without saying that the catalytic device according to the present invention is not limited to the above-described embodiment and can adopt various configurations within the scope of the present invention.

What is claim is:

1. A catalytic device comprising:

a catalyst support that is formed by metal leaf-shaped flat plate and corrugated plate being stacked and rolled and supports a catalyst; and an outer cylinder that houses the catalyst support and supports the catalyst support with one end of the catalyst support made to face an upstream side of exhaust gas and another end of the catalyst support made to face a downstream side of the exhaust gas, wherein, the flat plate and the corrugated plate have a plurality of holes, in a flat state in which the flat plate and the corrugated plate are not yet shaped into the catalyst support, the plurality of holes form a plurality of first lines by aligning in a first direction that is parallel to a direction of an axis of the catalyst support and form a plurality of second lines by aligning in a second direction that is orthogonal to the first direction, a joint area between the flat plate and the corrugated plate is provided in a first upstream area including the one end of the catalyst support, and a joint area between the catalyst support and the outer cylinder is provided in a second upstream area including the one end of the catalyst support.

2. The catalytic device according to claim 1, wherein the joint area between the catalyst support and the outer cylinder is provided in the second upstream area that includes the first upstream area and is wider than the first upstream area in the direction of the axis.

3. The catalytic device according to claim 1, wherein a predetermined number of the second lines are included in the first upstream area.

4. The catalytic device according to claim 1, wherein the joint area between the flat plate and the corrugated plate is provided in a downstream area that includes another end of the catalyst support.

* * * * *